US006519436B2

(12) United States Patent
Katsuyama

(10) Patent No.: US 6,519,436 B2
(45) Date of Patent: Feb. 11, 2003

(54) TONER POWDER CONTAINER FOR STORING TONER APPLICABLE TO AN ELECTROGRAPHIC IMAGE FORMING APPARATUS, A METHOD AT ASSEMBLING THE SAME, AND A METHOD OF REDUCING THE VOLUME OF THE SAME

(75) Inventor: Goro Katsuyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/793,582

(22) Filed: Feb. 27, 2001

(65) Prior Publication Data

US 2001/0033758 A1 Oct. 25, 2001

(30) Foreign Application Priority Data

Feb. 29, 2000 (JP) ..... 2000-053583
Jan. 17, 2001 (JP) ..... 2001-009310

(51) Int. Cl.[7] ..... G03G 15/08

(52) U.S. Cl. ..... 399/258; 229/117.27; 229/117.3; 229/117.35; 399/262

(58) Field of Search ..... 399/262, 119, 399/120, 27, 258; 229/117.27, 117.28, 117.3, 117.35; 222/494, 492, 490, 95, 92, 96, 105, 106

(56) References Cited

U.S. PATENT DOCUMENTS 5,474,203 A * 12/1995 Baker ..... 222/105
5,655,179 A * 8/1997 Ueda et al. ..... 399/262
5,788,121 A * 8/1998 Sasaki et al. ..... 222/105
6,079,594 A * 6/2000 Brown et al. ..... 222/494
6,155,457 A * 12/2000 Landa et al. ..... 222/95
6,158,621 A * 12/2000 Keller ..... 222/105
6,223,956 B1 * 5/2001 Albers ..... 222/494
6,393,241 B1 * 5/2002 Matsumoto et al. ..... 399/258

FOREIGN PATENT DOCUMENTS

| | | | |
|---|---|---|---|
| EP | 1 006 415 | | 6/2000 |
| FR | 2 775 658 | | 9/1999 |
| JP | 6-274031 | * | 9/1994 |
| JP | 09-22175 | * | 1/1997 |
| JP | 11-119536 | * | 4/1999 |
| JP | 11-282236 | * | 10/1999 |

OTHER PUBLICATIONS

P. M. Wegman, XEROX Disclosure Journal, vol. 2, No. 5, p. 253, "Bulk Bag Filter–Vent", Sep./Oct. 1997.

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

A powder container of the present invention is made up of a flexible or deformable bag storing powder therein and a box for accommodating the bag. A seal valve is fitted in an outlet portion formed in the bag while a cap removably closes the outlet portion. When the bag is pressed in the collapsing direction, the powder is prevented from flying about via the seal valve. The powder container is easy to assemble.

45 Claims, 20 Drawing Sheets

TONER POWDER CONTAINER FOR STORING TONER APPLICABLE TO AN ELECTROGRAPHIC IMAGE FORMING APPARATUS, A METHOD AT ASSEMBLING THE SAME, AND A METHOD OF REDUCING THE VOLUME OF THE SAME

BACKGROUND OF THE INVENTION

The present invention relates to a powder container, a method of assembling the same, and a method of reducing the volume of the same. More particularly, the present invention relates to a toner container for storing toner applicable to an electrophotographic image forming apparatus, a method of assembling the same, and a method of reducing the volume of the same.

It has been customary with an image forming apparatus to use a toner container implemented as a cartridge, bottle or similar hard case. The kind of toner container, however, has a problem in the replacement aspect. Specifically, a manufacturer shipped the hard toner container to a user's station collects the container run out of toner and then recycles, reuses or burns it. The hard toner container needs high distribution costs up to the time of collection.

In light of the above, a toner container whose volume can be reduced has been proposed in the past. Such a toner container, however, cannot stably replenish toner via a toner replenishing device. While a toner container whose volume can be reduced only during transport has also been proposed, it causes toner to fly about and contaminate surroundings when transferred to a hard bottle or a toner hopper.

Further, a toner replenishing device has been proposed that can stably replenish toner even from a toner container implemented by a resin, paper or similar flexible sheet and can replenish it to a developing unit remote from the container. In addition, it has been proposed to insert a nozzle into the toner container and send air into the toner container via the nozzle while discharging the toner.

The toner container for the above-described type of toner replenishing device has a toner outlet in which a self-closing valve formed of, e.g., sponge is fitted. The self-closing valve opens when a nozzle is inserted and closes when it is removed. The problem with the self-closing valve is that when the toner container run out of toner is pulled out, the self-closing valve is released form the nozzle in a slightly open position. Further, because air is sent into the toner container in order to discharge toner, some air is left in the container when the container runs out of toner. It follows that when the toner container pulled out is pressed in the collapsing direction, toner flies about via the slightly open self-closing valve.

Moreover, it is difficult for a flexible toner container to maintain its position while in use. In addition, such a container is difficult to handle in the event of mounting and dismounting. Therefore, a flexible toner container should preferably be accommodated in a rigid box. This, however, brings about another problem that the rigid box increases the cost of the toner container.

Technologies relating to the present invention are disclosed in, e.g., Japanese Patent Laid-Open Publication Nos. 6-274031, 9-22175, 11-119536 and 11-282236.

SUMMARY OF THE INVENTION

It is an object of the present invention to provide a flexible powder container capable of preventing powder contained therein from leaking in the event of mounting and dismounting, and preventing it from flying about even when pressed in the collapsing direction.

It is another object of the present invention to provide a method that allows the powder container to be easily assembled.

It is a further object of the present invention to provide a method of reducing the volume of the powder container.

In accordance with the present invention, a powder container includes a deformable, powder storing body storing powder therein, and a box more rigid than the bag for accommodating the powder storing body. A powder outlet portion is included in the powder storing body and partly shows itself at the outside of the box when the powder storing body is accommodated in the box. A self-closing valve is fitted in the powder outlet portion and opens when an insertion member is inserted or closes when it is pulled out. A closing member is removably attached to the powder outlet for closing the self-closing valve.

The powder storing body should preferably include an exhausting portion for exhausting the powder storing body of air while filtering out the powder.

Preferably, walls constituting the box each have a contiguous side contiguous with the adjoining wall and a separate side and are capable of being developed in the form of a single sheet.

Also, in accordance with the present invention, a method of framing a box is applicable to a powder container, which is made up of a deformable powder storing body storing powder therein and the box more rigid than the powder storing body for accommodating the toner storing body. The method begins with the step of preparing the box developed in the form of a single sheet and having rectangular walls each having a-contiguous side contiguous with the adjoining wall and a separate side. One of the walls has four contiguous sides in both of the up-and-down direction and right-and-left direction. The box is positioned in a jig such that the walls contiguous with the one wall in the up-and-down direction are folded at an angle that forms a box. Subsequently, the walls contiguous with the one wall in the right-and-left direction is folded upward such that said walls meet the walls that are contiguous with the one wall in the up-and-down direction.

Further, in accordance with the present invention, a volume reducing method reduces the volume of a deformable, powder storing body included in a powder container, which is made up of the powder storing body storing powder therein and a box more rigid than the powder storing body for accommodating the toner storing body, after substantially fully discharging the powder from the powder container. The method includes the steps of closing a powder outlet portion included in the powder storing body with a closing member, and pressing the powder storing body in a direction in which the powder storing body collapses to thereby exhaust the powder storing body of air.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
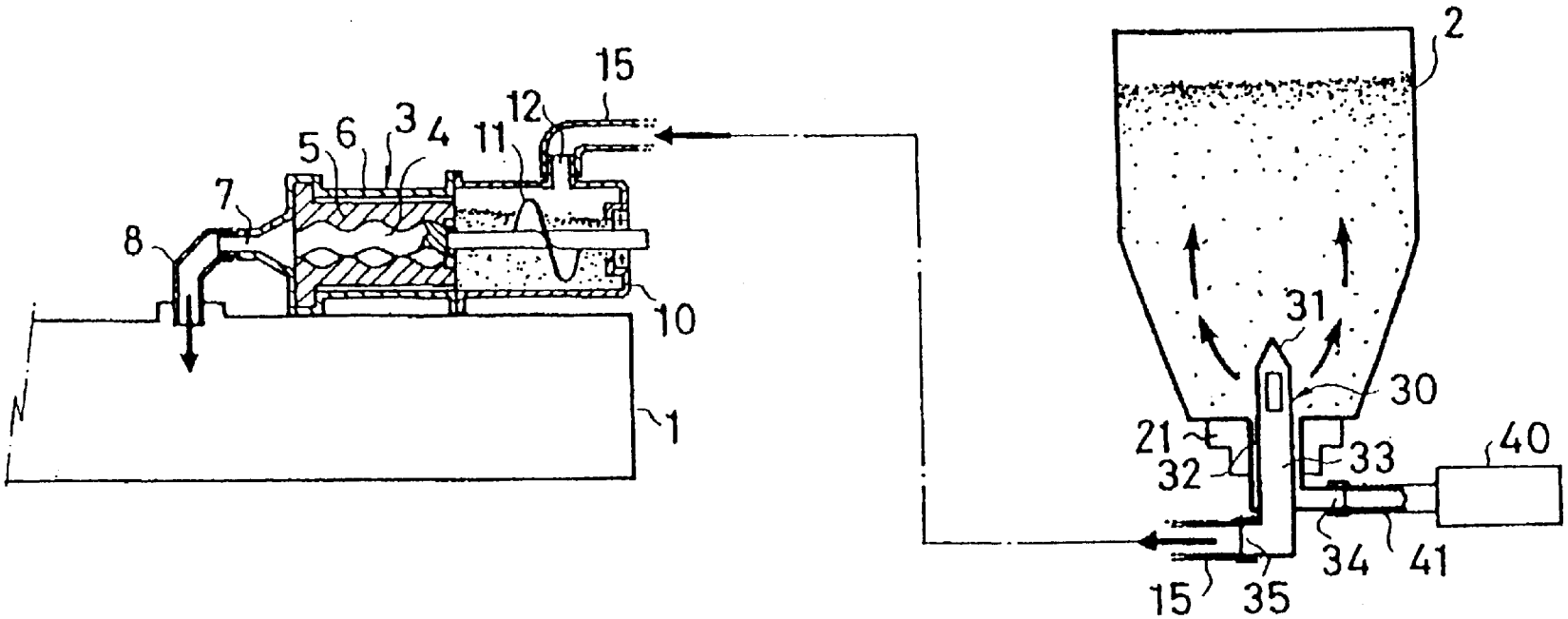
FIG. 1 is a view showing a specific configuration of a toner replenishing mechanism included in an image forming apparatus to which a preferred embodiment of the present invention is applied.
Figure 2:
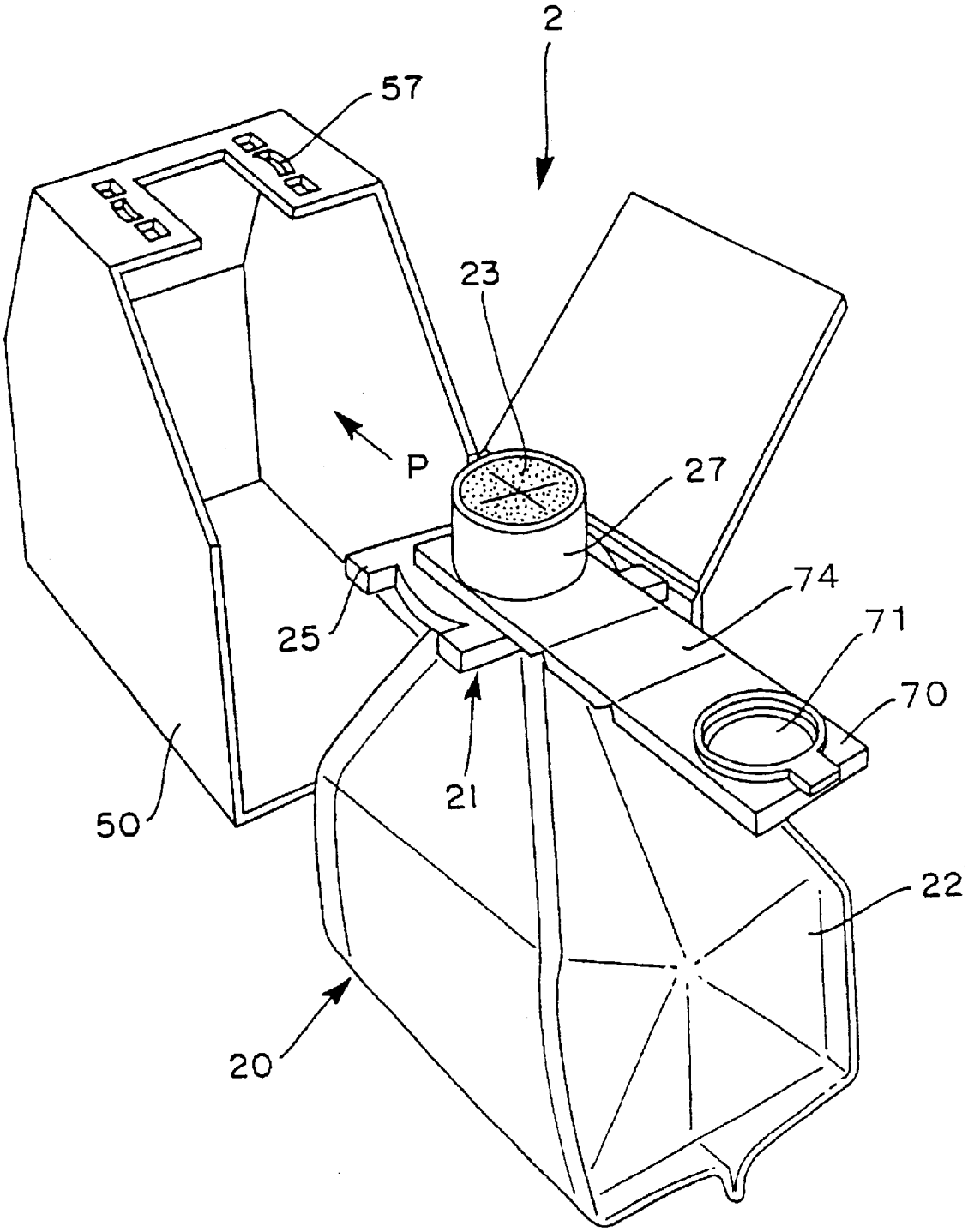
FIG. 2 is an isometric view showing a specific configuration of a toner container included in the illustrative embodiment.

Referring to FIGS. 1 and 2, a toner replenishing device included in an image forming apparatus and to which a powder container embodying the present invention is applied is shown. As shown, the image forming apparatus includes a developing unit 1 and a toner container 2. The toner container 2 is a specific form of the powder container and stores powdery toner therein. In the illustrative embodiment, the toner container 2 is implemented as a bag-in-box type container made up of a deformable bag or toner storing body 20 and a box 50 accommodating the bag 20. The box 50 is more rigid than the bag 20.

The toner container 2 is a unit separate from the developing unit 1 and removably mounted to a mount portion included in the body of the apparatus from above the apparatus. The mount portion maybe positioned within the apparatus such that it is accessible when, e.g., a door or a cover mounted on the apparatus body is opened. Alternatively, the mount portion may be arranged on the outside of the apparatus body, if desired.

The mount portion includes an upright nozzle 30 capable of penetrating into the toner container 2 when the container is set. The nozzle 30 has a conical tip member 31 molded integrally with, adhered to or otherwise mounted on its top. The nozzle has a double-tube structure defining an air inlet passage 32 and a toner outlet passage 33, which are contiguous with the tip member 31. The toner outlet passage 33 is bent to the left, as viewed in FIG. 1, at the bottom of the nozzle 30 and formed with an opening 35 at its end. The air inlet passage 32 is bent to the right, as viewed in FIG. 1, at a level higher than the toner outlet passage 33 and formed with an opening 34 at its end.

In the illustrative embodiment, the opening 34 of the air inlet passage 32 is communicated to an air pump or air feeding means 40 by a pipe 41. The air pump 40 delivers air under pressure into the toner container 2 via the pipe 41 and air inlet passage 32. Air jetted into the toner container 2 flows through a toner layer and fluidizes the toner layer by scattering it.

A suction type powder pump 3 is located in the vicinity of or constructed integrally with the developing unit 1. The powder pump 3 is a single axis, eccentric screw pump and made up of a rotor 4, a stator 5 and a holder 6. The rotor 4 is made of metal or similar rigid material and provided with an eccentric, screw-like configuration. The stator 5 is formed of rubber or similar elastic material and provided with a double-screw configuration. The holder 6 accommodates the rotor 4 and stator 5 therein in such a manner as to form a toner passage and is formed of, e.g., resin. A toner outlet 7 is formed at the left end of the holder 6, as viewed in FIG. 1. A pipe 8 provides fluid communication between the toner outlet 7 and a toner inlet, not shown, formed in the developing unit 1.

A buffer or toner storing means 10 is connected to the inlet side of the powder pump 3 in order to store an adequate amount of toner. A screw or toner conveying means 11 is disposed in the buffer 10 and protrudes to the outside of the buffer 10 at one end. A drive source, not shown, is drivably connected to the protruding end of the screw 11. The other end of the screw 11 is connected to the rotor 4. In this configuration, the powder pump 3 and screw 11 are caused to operate at the same time as each other.

A toner inlet 12 is formed in the buffer 10. A flexible tube 15 communicates the toner inlet 12 to the opening 35 of the nozzle 30. The tube 15 has a diameter of, e.g., 4 mm to 10 mm and is formed of polyurethane, nitril, EPDM, silicone or similar rubber highly resistant to toner. The tube 15 with flexibility can be easily laid in any desired direction, i.e., upward, downward, rightward or leftward.

In the toner replenishing device having the above configuration, the powder pump or screw pump 3 can continuously deliver toner with a high solid-to-gas ratio by an accurate, constant amount, which is proportional to the rotation speed of the rotor 4, as well known in the art. In response to a replenishment command derived from, e.g., sensed image density, the powder pump 3 is operated to replenish a required amount of toner to the developing unit 1.

Figure 4:
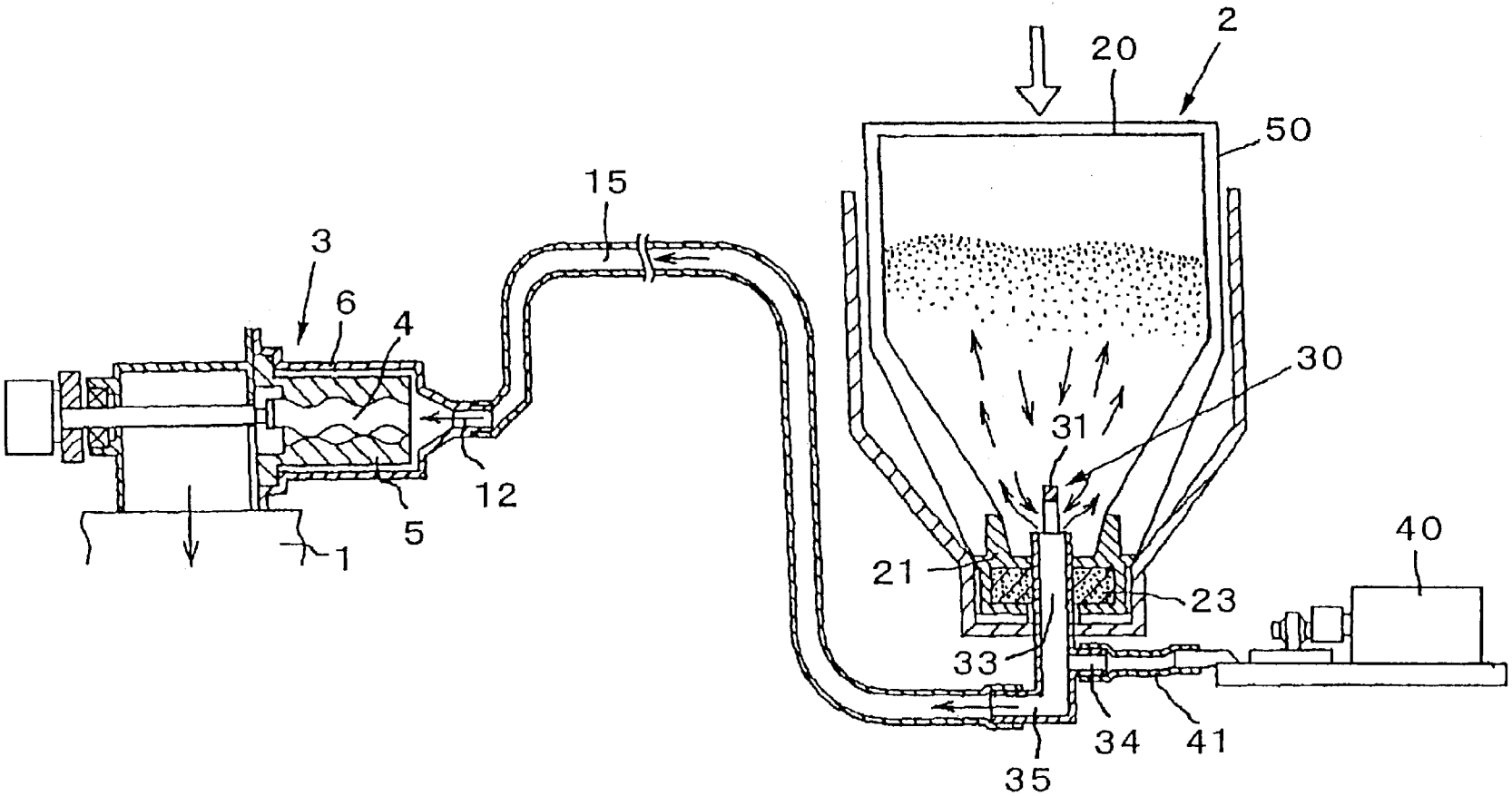
FIG. 4 is a section showing another specific configuration of the toner replenishing device.

FIG. 4 shows another specific configuration of the toner replenishing device. This toner replenishing device differs from the device shown in FIG. 1 in that the buffer 10 is absent, and in that the nozzle 30 has a single wall structure. In FIG. 4, structural elements identical with the structural elements shown in FIG. 1 are designated by identical reference numerals, and a detailed description thereof will not be made in order to avoid redundancy.

As shown in FIG. 4, the nozzle 30 is a straight, cylindrical tube in which an air inlet/toner outlet passage 33 is formed. The passage 33 is communicated to the tip member 31. The passage 33 is bent to the left, as viewed in FIG. 4, at the bottom of the nozzle 30 and terminates at the opening 35. The tube 15 is connected to the opening 35. Further, the passage 33 is bent to the right, as viewed in FIG. 4, at a level higher than the opening 35 and terminates at the opening 34. When the powder pump 3 is energized, it sucks toner out of the toner container 2 and replenishes it to the developing unit 1.

Figure 3:
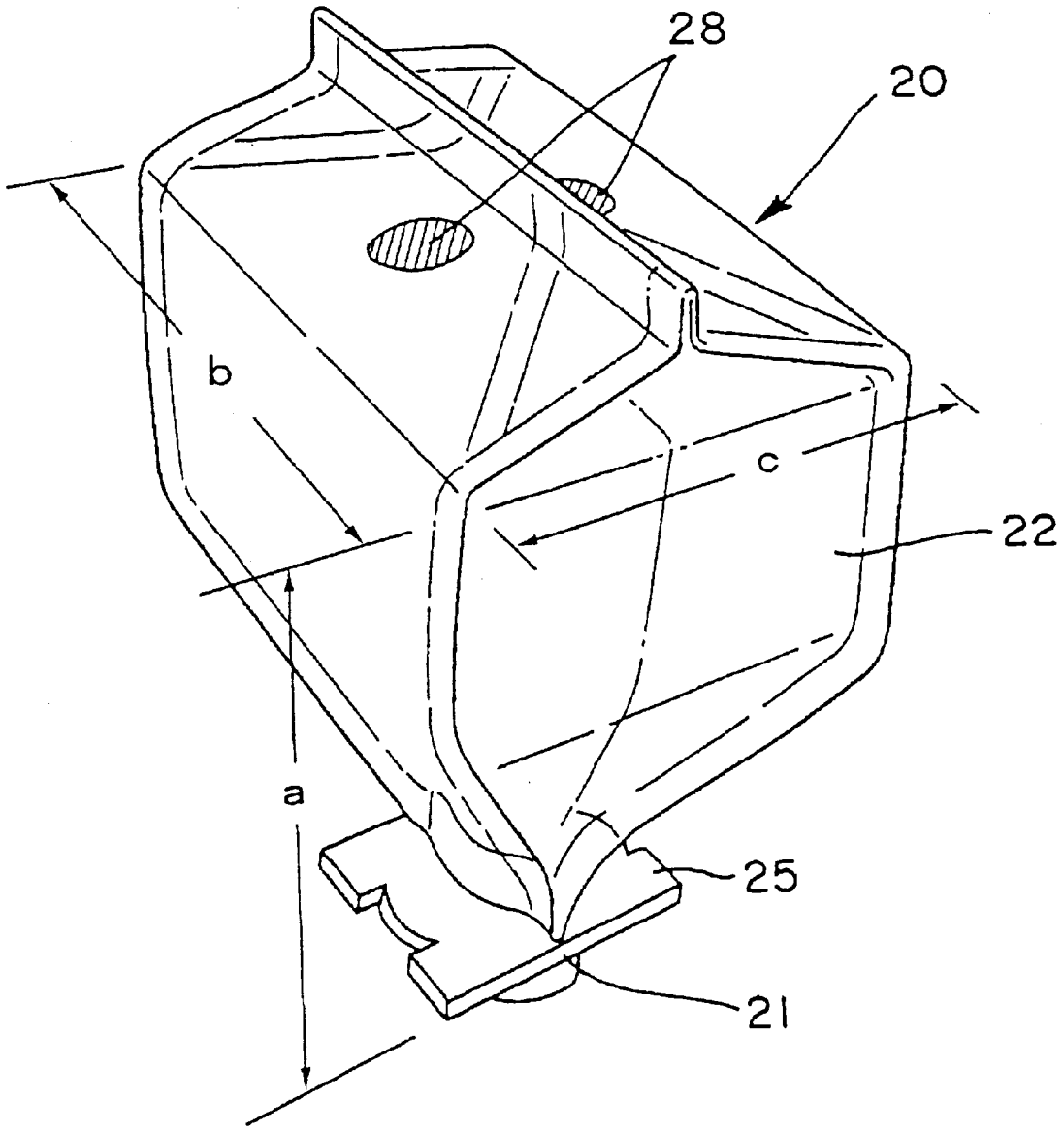
FIG. 3 is an isometric view showing a bag included in the toner container.

The toner container 2 will be described more specifically with reference to FIG. 2. As shown, the bag or toner storing body 20 is made up of a mouth member 21 and a bag 22 affixed to the mouth member 21. The mouth member 21 is formed of, e.g., resin by blow molding or similar technology and includes a toner outlet. The bag 22 is implemented by a flexible sheet or a laminate of flexible sheets formed of polyethylene, nylon or similar resin and 80 $\mu$m to 200 $\mu$m thick each. As shown in FIG. 3, the bag 20 is provided with filters 28 at its side substantially opposite to the side where the mouth member 21 is positioned. The filters 28 pass air therethrough, but does not pass toner.

Figure 5:
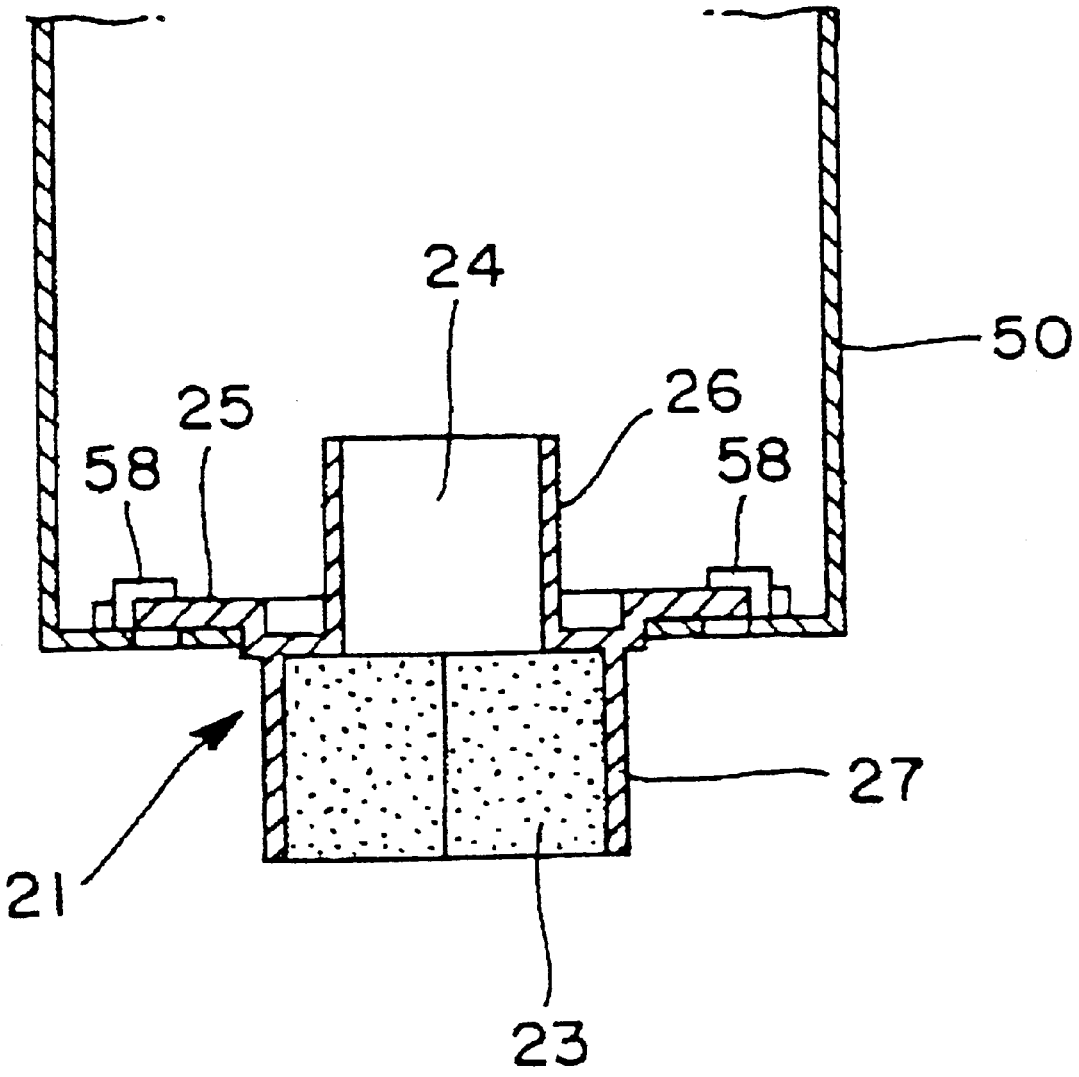
FIG. 5 is a section showing a mouth member included in the toner container.
Figure 6:
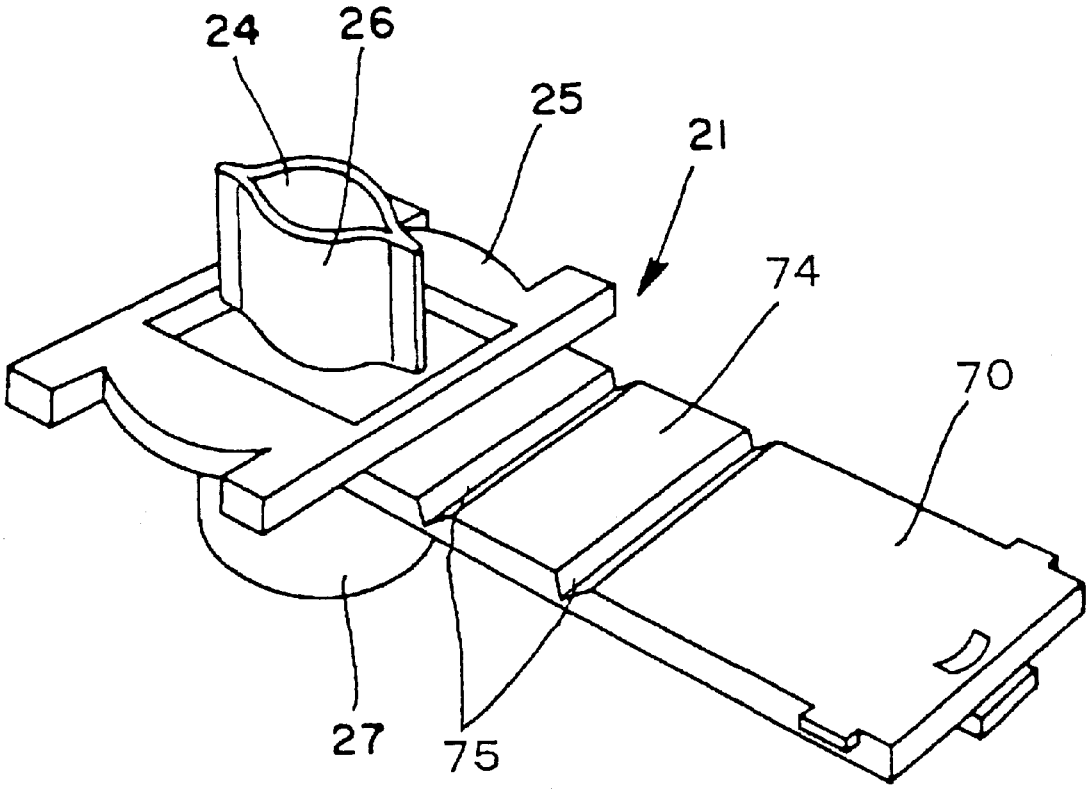
FIG. 6 is a perspective view of the mouth member shown in FIG. 5.

As shown in FIGS. 5 and 6, the mouth member 21 includes a through hole 24 extending in the up-and-down direction and forming the toner outlet. A flat slider 25 is affixed to or formed integrally with the outer periphery of the wall that forms the through hole 24. The slider 25 is generally rectangular and constitutes projections forming part of connecting means. When the bag 20 is inserted into the box 50 in a direction indicated by an arrow P in FIG. 2, the slider 25 is received in guide portions or pockets 58 (see FIG. 5) formed on the box 50, thereby connecting the bag 20 to the box 50.

Figure 18:
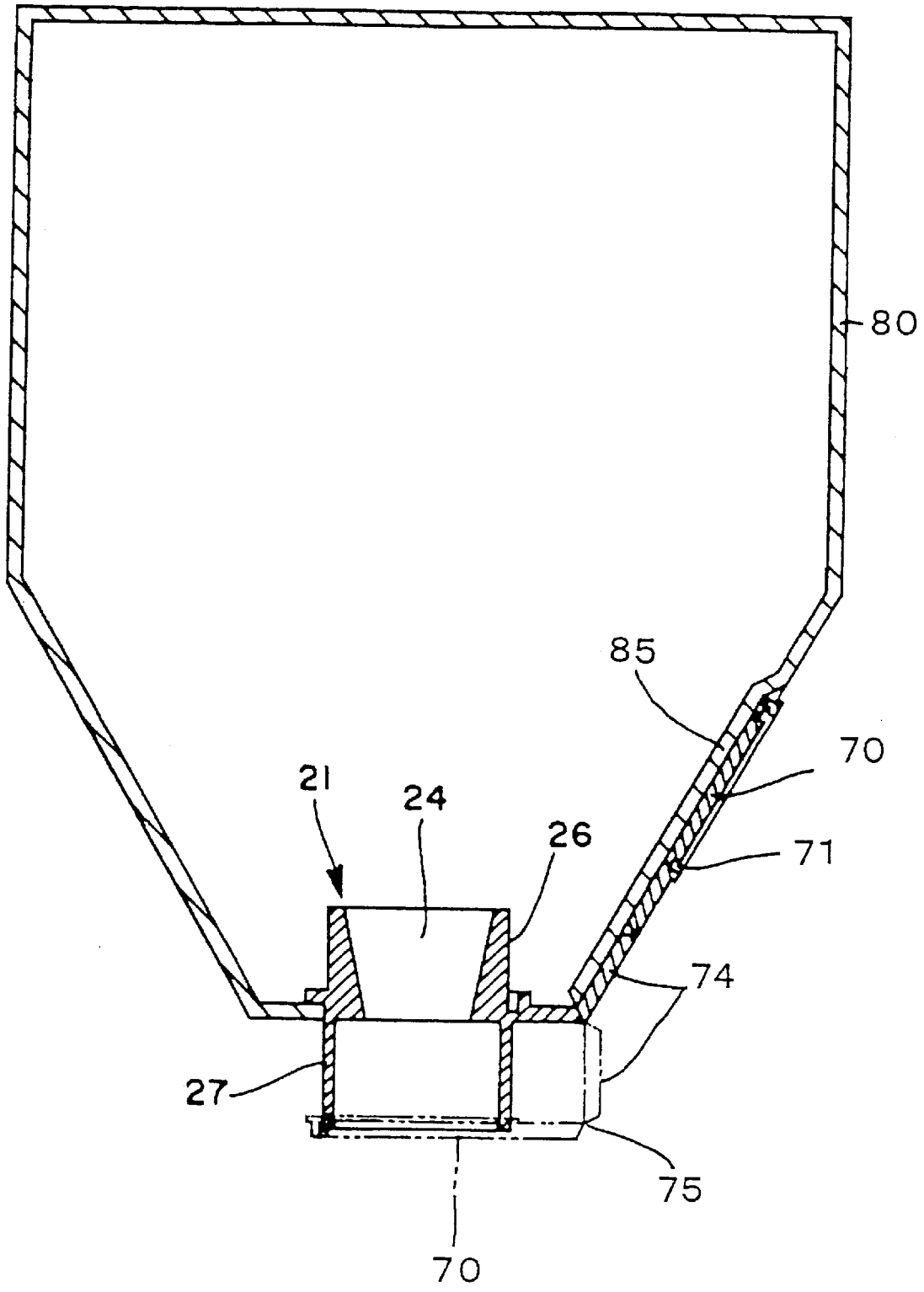
FIG. 18 is a section showing a relation between the box and a cap also included in the toner container.

The flexible bag 22 is affixed to a boat-shaped protuberance 26, which is also included in the mouth member 21 above the slider 25. An outlet portion 27 is positioned below the slider 25 and forms the through hole 24. A seal valve or self-closing valve 23 is fitted in the outlet portion 27 and formed of an elastic material, preferably foam sponge. A cap 70 is formed integrally with the mouth member 21 via a connecting portion 74 in order to close the outlet portion 27. A circular recess 71 is formed in the cap 70 and capable of mating with the outlet portion 27. As shown in FIG. 18, the connecting portion 74 has a length, as measured in the connecting direction, substantially equal to the height of the outlet portion 27. As shown in FIG. 6, generally V-shaped grooves 75 are formed in the opposite ends of the connecting portion 74 in the direction of connection. The cap 70, mouth member 21 and connecting portion 74 may be implemented as a single molding of resin.

Figure 7:
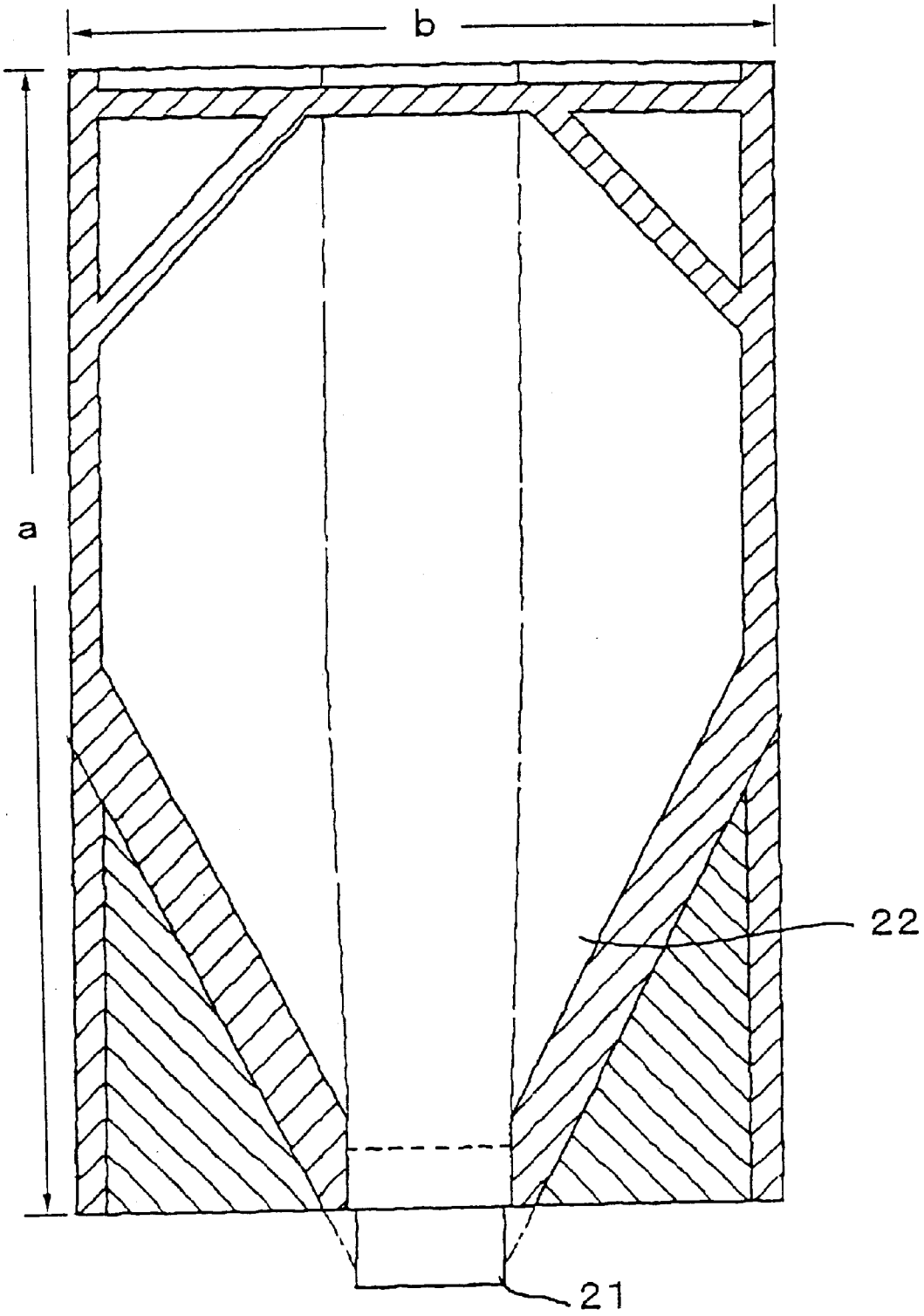
FIG. 7 is a view showing a specific configuration of the bag in a position just after production.

FIG. 7 is a front view showing a specific configuration of the bag 20 in a position just after production and not packed with toner. When the bag 20 is packed with a preselected amount of toner, the bag 20 appears as shown in FIG. 3. As shown in FIG. 7, assume that the bag 20 has a height a and a width b. Then, in the illustrative embodiment, the height a and width b are selected to be about 185 mm and about 113 mm, respectively. Further, the bag 20 has a depth c (see FIG. 3) selected to be about 63 mm. With such dimensions, the bag 20 is capable of accommodating about 300 grams of toner.

Figure 8:
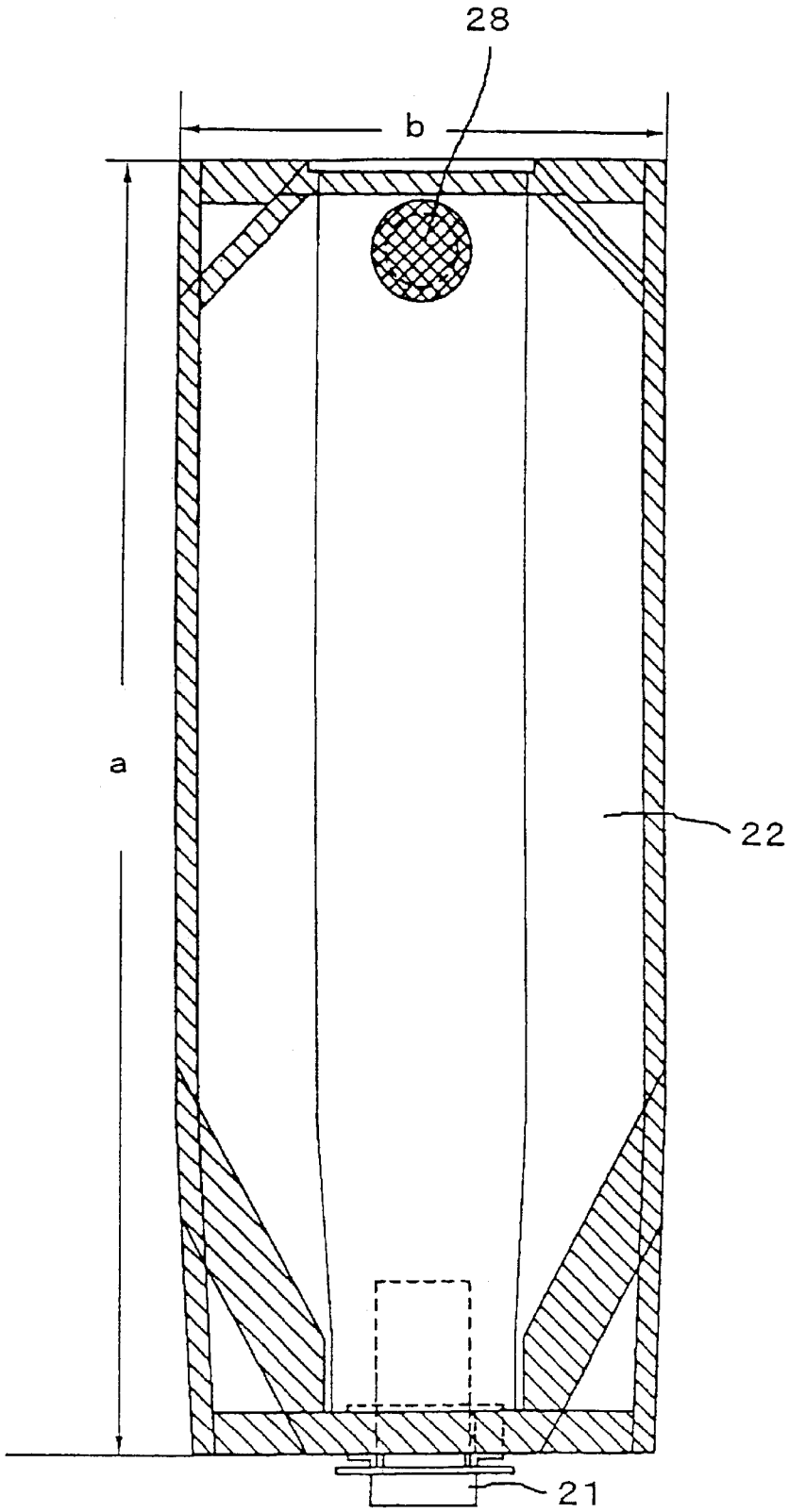
FIG. 8 is a view showing another specific configuration of the bag in the same position as in FIG. 7.

FIG. 8 shows other specific dimensions of the bag 20. As shown, the bag 20 has a height a of about 305 mm, a width b of about 113 mm, and a depth c of about 55mm and can accommodate about 600 grams of toner. The filters 28 each has a diameter of 1.75 cm, an area of about 2.4 $cm^2$, and air permeability of 2 to 7 $ml/cm^2.sec \times 2.4\ cm^2$, i.e., 4.8 to 16.8 ml/sec.

Figure 9:
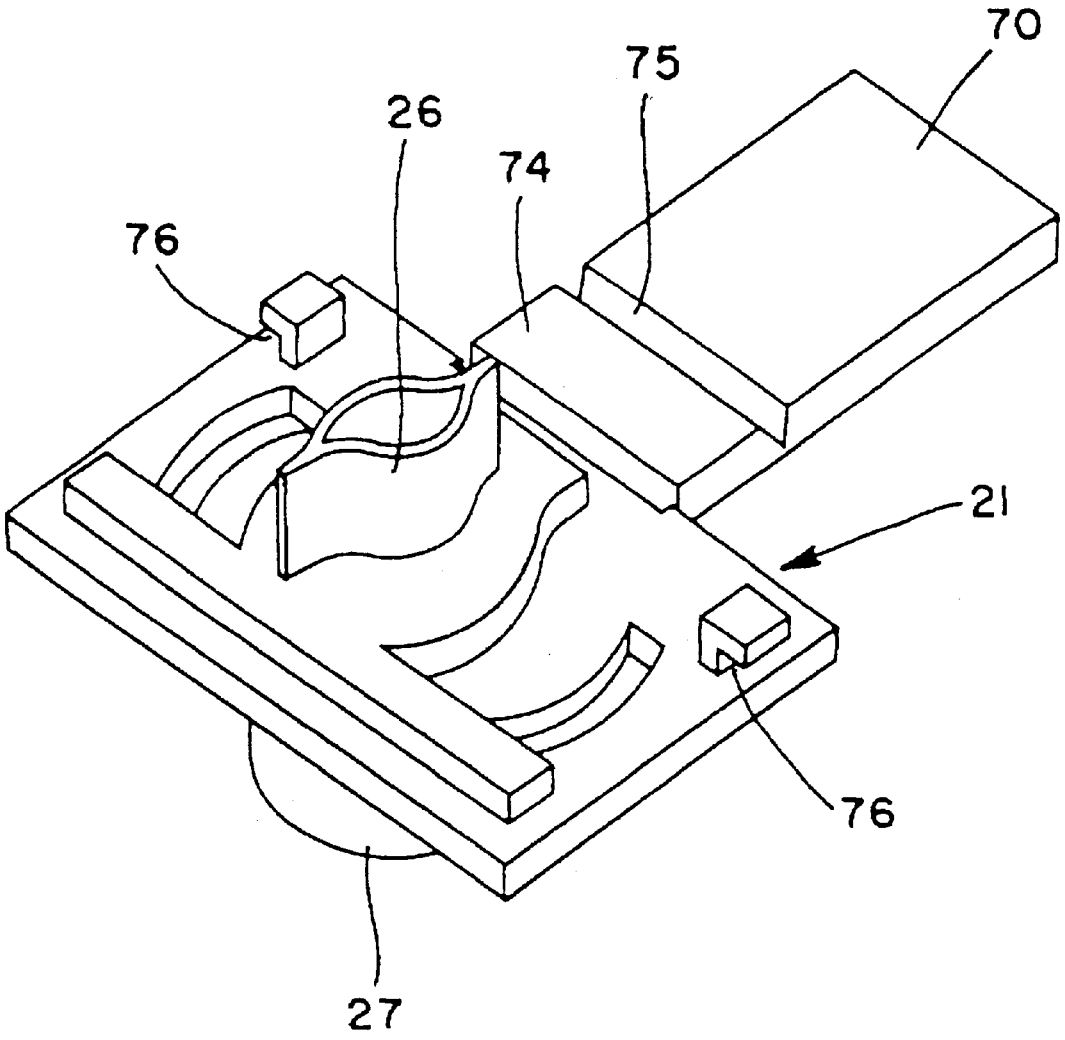
FIG. 9 is a perspective view showing another specific configuration of the mouth member.
Figure 10:
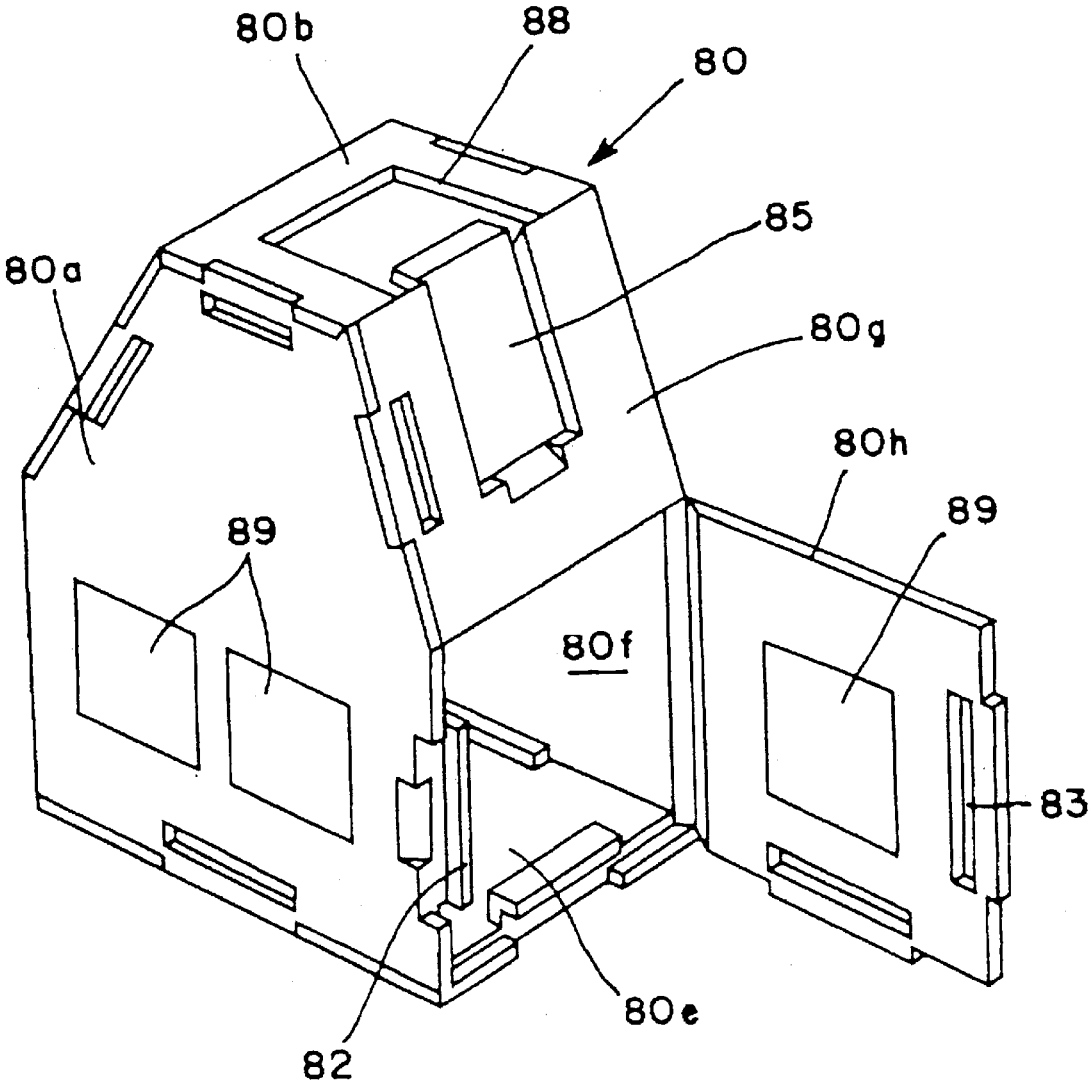
FIG. 10 is an isometric view showing another specific configuration of a box included in the illustrative embodiment.

FIG. 9 shows another specific configuration of the mouth member 21. As shown, the mouth member 21 is formed with pockets 76 that serve as means for connecting the mouth member 21 to a box 80 shown in FIG. 10. As shown in FIG. 10, a generally rectangular opening is formed in the upper portion of the box 80. The opposite edges of this opening, which form lugs, and the pockets 76 of the mouth member 21 mate with each other, connecting the mouth member 21 to the box 80. As for the rest of the configuration, the mouth member 21 of FIG. 9 is identical with the mouth member of FIG. 5. Again, the cap 70, mouth member 21 and connecting portion 74 are implemented as a single molding of resin.

Figure 11:
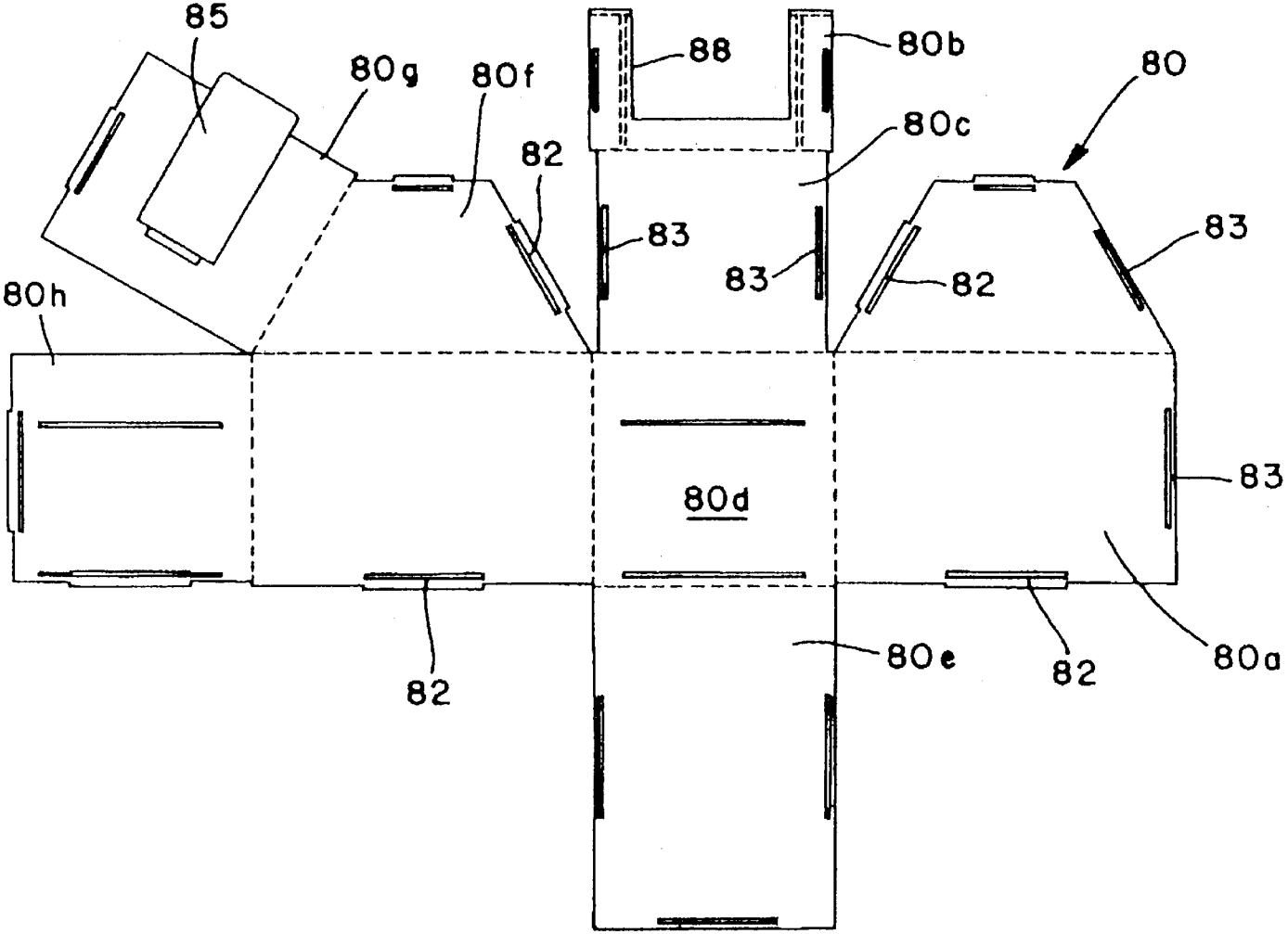
FIG. 11 is a developed view showing the outside of the box of FIG. 10.

FIG. 11 shows a specific configuration of the box 80 shown in FIG. 10 in a developed view. As shown, the box 80 has eight walls 80*a* through 80*h*. The walls 80*a* through 80*h* have straight sides contiguous with each other and straight sides separate from each other, and each has at least one side contiguous with the side of the adjoining wall. Therefore, by suitably selecting the contiguous sides and separate sides of the walls 80*a* through 80*h*, it is possible to develop the box 80 in the form of a single sheet having any one of various shapes. The contiguous sides prevent the walls 80*a* through 80*h* from fully parting from each other at the time of development.

Figure 12:
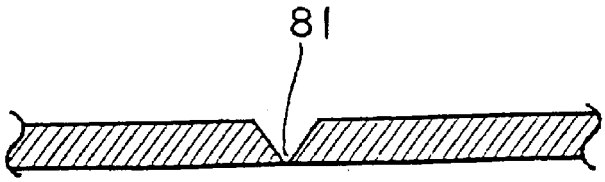
FIG. 12 is a fragmentary view of the box shown in FIG. 11.

As shown in FIG. 12, a V-shaped groove 81 is formed in each of the contiguous sides of the walls 80*a* through 80*h* in order to limit a foldable angle. The angle of the letter V is selected in accordance with the angle by which each contiguous side is to be folded. For example, when the angle of the letter V is 90 degrees, nearby walls contiguous with each other via the groove 81 can be folded by substantially 90 degrees in the direction in which the surfaces forming the letter V contact each other. On the other hand, the nearby walls can be folded up to contact each other when folded in the other direction in which the surfaces forming the letter V move away from each other.

Figure 13:
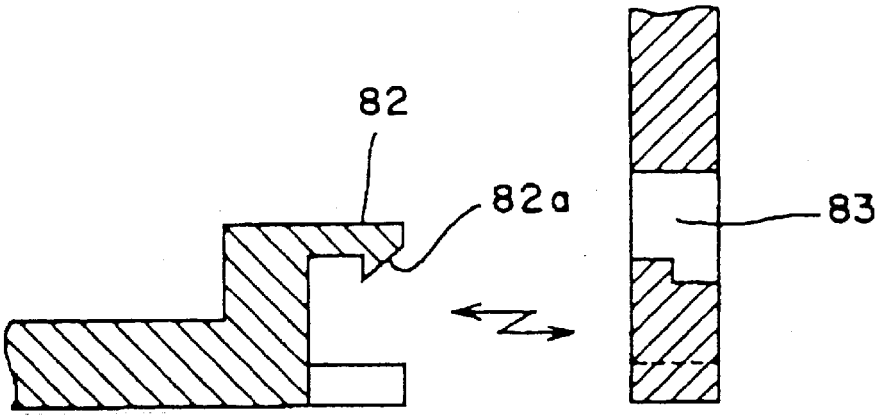
FIG. 13 is a section showing fastening means for fastening the walls of the box.
Figure 14:
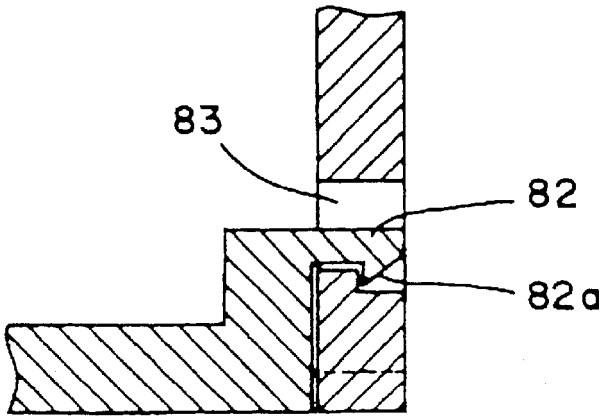
FIG. 14 is a section showing walls fastened to each other by the fastening means.

As shown in FIG. 13, tongues 82 (only one is shown) protrude from one of the adjoining separate edges of the walls 80*a* through 80*h*. Holes 83 (only one is shown) are formed in the other of the adjoining separate edges of the walls 80*a* through 80*h*. As shown in FIG. 14, the tongues 82 and holes 83 mate with each other and constitute fastening means for fastening nearby walls 80*a* through 80*h*. To frame the box 80, the walls 80*a* through 80*h* in the form of a flat sheet are folded inward in a suitable sequence with the tongues 82 mating with the holes 83. The box 80 can therefore be framed without resorting to any tool.

A preferred procedure for framing the box 80 will be described herein after. In the developed position shown in FIG. 11, the wall 80*d* of the box 80 is rectangular and continuous with the walls 80*c* and 80*e* in the up-and-down direction and contiguous with the walls 80*a* and 80*f* in the right-and-left direction and therefore does not have any separate side. The walls 80*a* and 80*f* each have a trapezoidal top.

Figure 15:
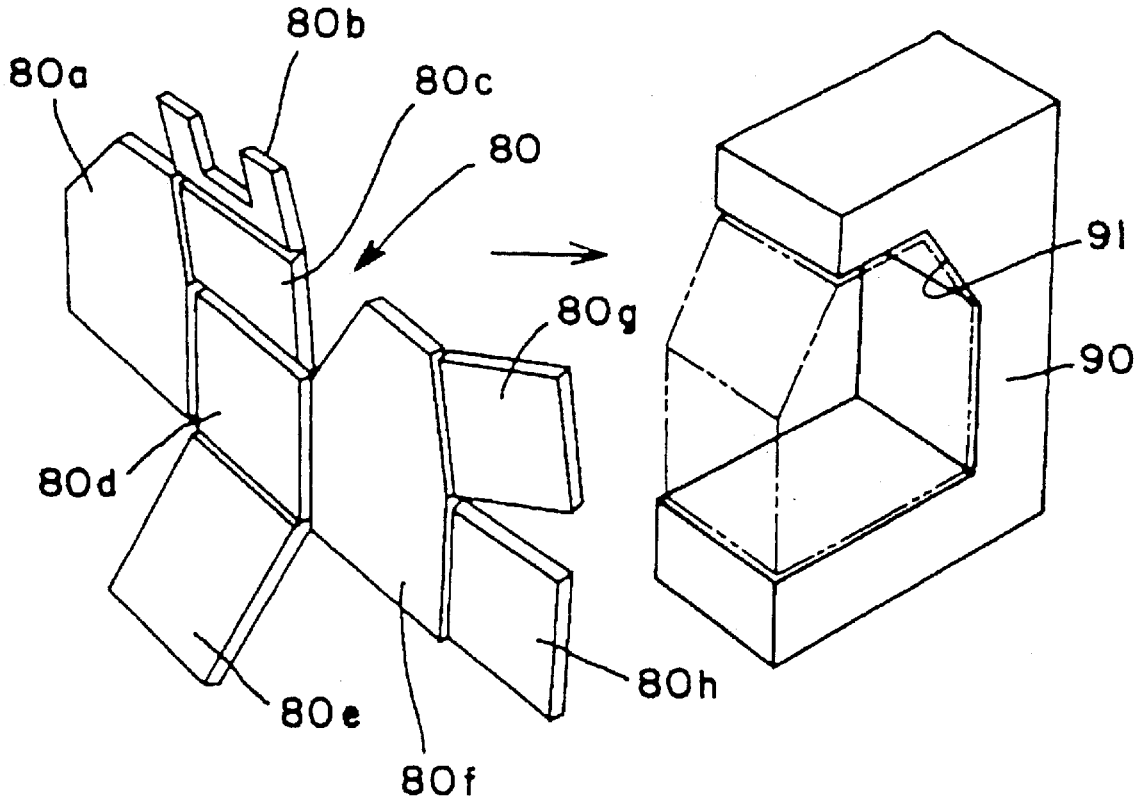
FIG. 15 is an isometric view demonstrating the initial stage of a specific method of assembling the box.

As shown in FIG. 15, to frame the box 80, use is made of a jig 90 formed with a cavity 91. The cavity 91 is configured such that the wall 80*d* is located at the deepest position in the cavity 91 while the walls 80*b*, 80*c* and 80*e*, which are contiguous with the wall 80*d* in the up-and-down direction, are so angled as to form part of the box 80. When the walls

Figure 16:
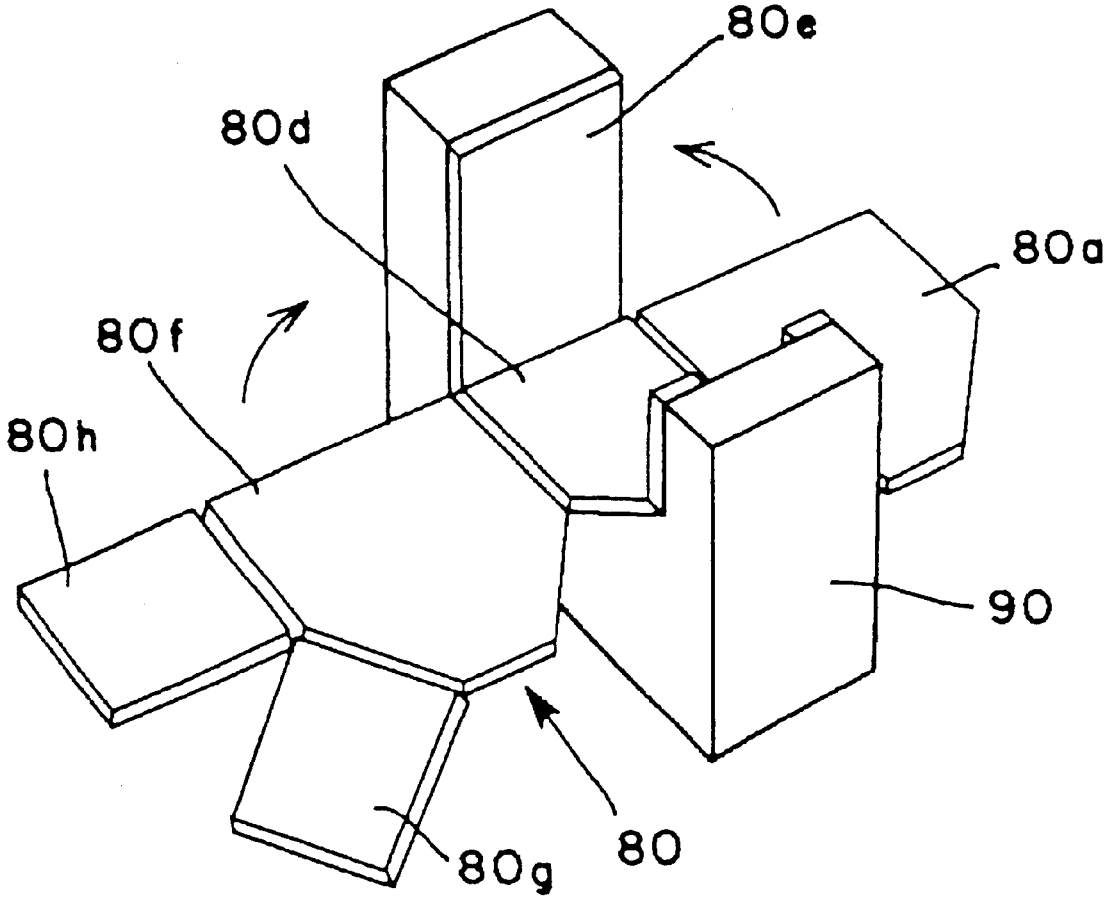
FIG. 16 is an isometric view showing a stage following the initial stage.

80*d,* 80*b,* 80*c* and 80*e* are received in the cavity 91 in the above condition, the trapezoidal walls 80*a* and 80*b* protrude from the opposite sides of the cavity 91. As shown in FIG. 16, after the jig 90 has been so positioned as to locate the wall 80*d* at, e.g., the bottom, the walls 80*a* and 80*f* are folded upward to complete the box 80. The walls 80*h* and 80*g* are respectively contiguous with the straight side and inclined side of the wall 80*f*. These walls 80*h* and 80*g* are left open during assembly and closed after the insertion of the bag 20 into the box 80.

The walls 80*g* and 80*h* each are formed with the tongues 82 in their separate sides while all the walls 80*b,* 80*c* and 80*e* are formed with the holes 83 in their separate sides. Therefore, only if the walls 80*a* and 80*e* are folded upward, the tongues 82 automatically mate with the holes 83. The box 80 is therefore extremely easy to frame. More specifically, as shown in FIGS. 13 and 14, each tongue 82 has a tapered end 82*a*. The tapered end 82*a* abuts against the edge of the associated hole 83 and thereby causes the tongue 82 to elastically deform for a moment, so that the walls are fastened to each other.

Figure 17:
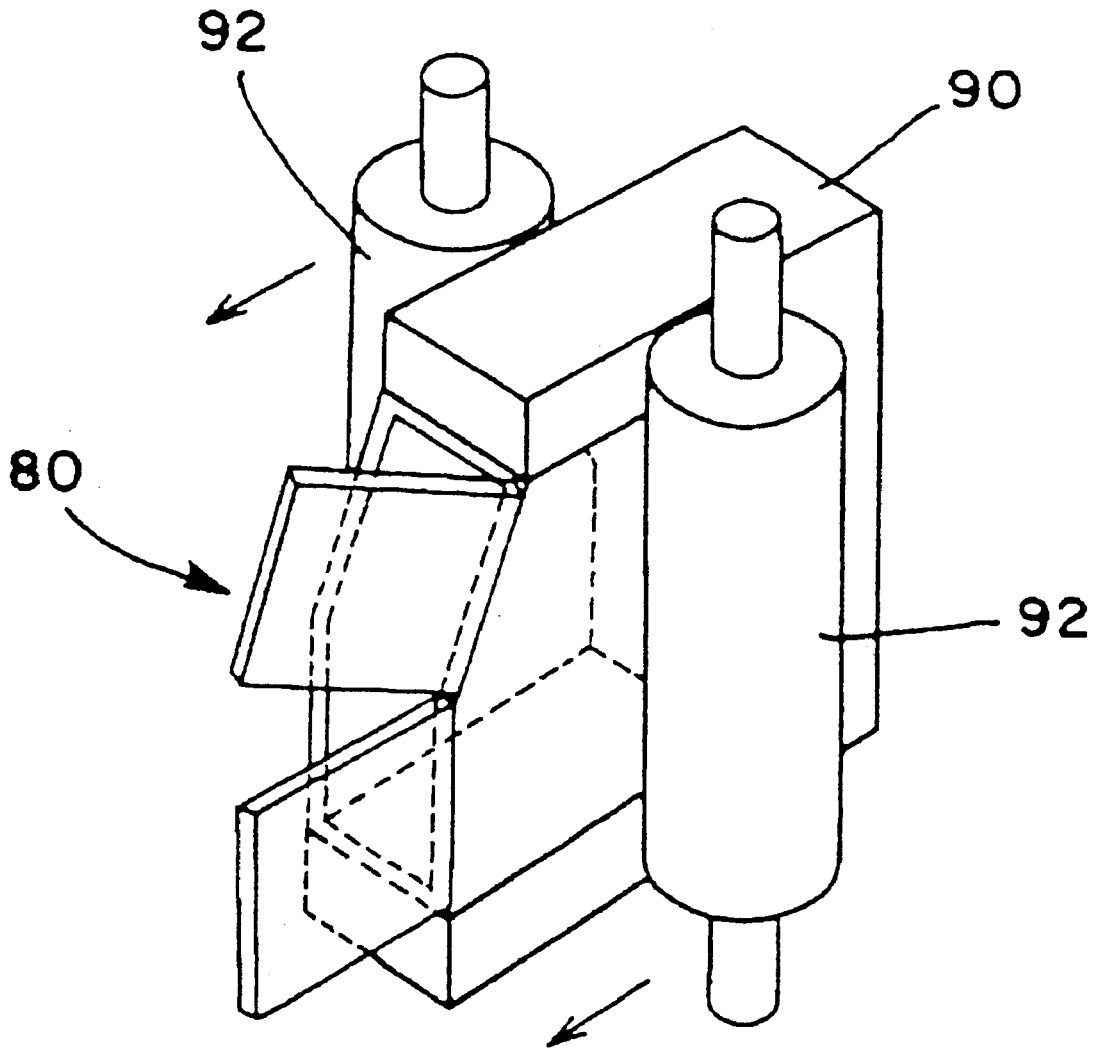
FIG. 17 is an isometric view showing an alternative method of assembling the box.

Further, as shown in FIG. 17, rollers 92 may be moved along the opposite sides of the jig 90 in a direction in which the walls 80*a* and 80*f* fold upward. This easily implements automatic assembly of the box 80.

The bag 20 packed with toner is fitted to the box 80 by the following procedure. Because the walls 80*g* and 80*h* of the box 80 are left open, the mouth member 21 is slid into the box 80 with its pockets 76 mating with the edges or lugs 88 of the rectangular opening of the box 80. Subsequently, the walls 80*g* and 80*h* are closed with their tongues 82 mating with the holes 83 of the wall 80*a,* fully assembling the toner container 2. The bag 20 has its outlet portion 27 closed by the cap 70 in order to prevent the toner from leaking during, e.g., assembly, as indicated by a dash-and-dots line in FIG. 18.

Figure 19:
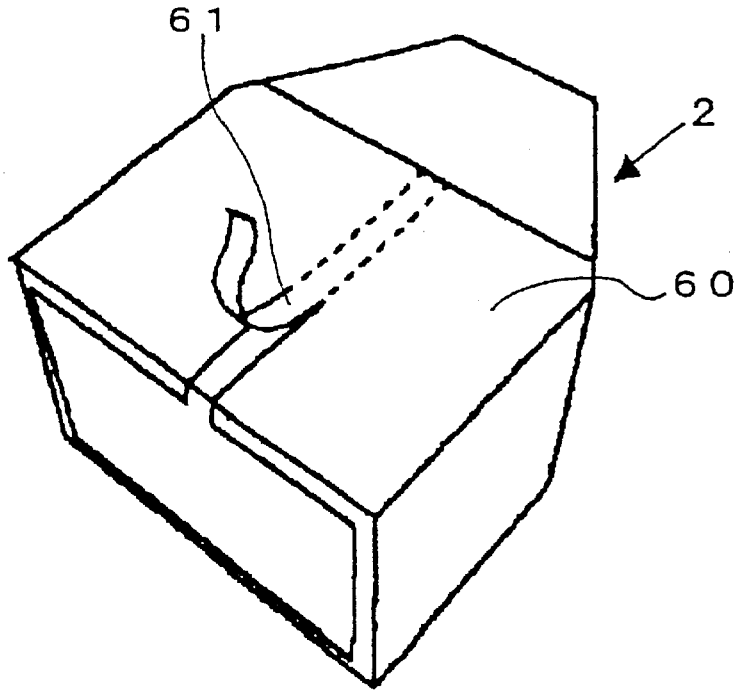
FIG. 19 is a view showing the toner container in a specific assembled condition.
Figure 20:
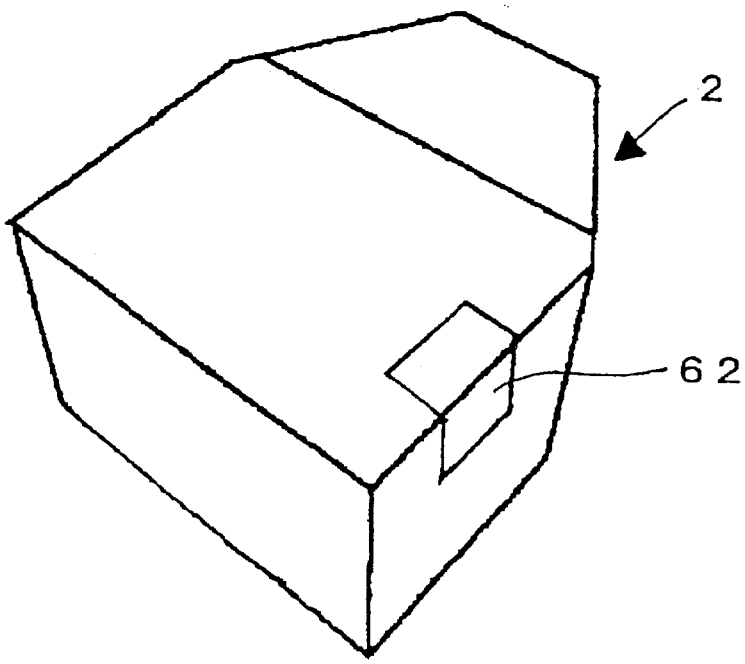
FIG. 20 is a view showing the toner container in another specific assembled condition.

As shown in FIG. 19, to prevent the walls 80*g* and 80*h* from easily unfolding, a seal 60 may be wrapped around all the side surfaces of the toner container 2. The seal 60 may be implemented by a thermally shrinkable seal by way of example. Further, the seal 60 may be provided with a shrink wrap 61 in order to allow the box 80 to be easily unfolded by hand. As shown in FIG. 20, the seal 60 may be replaced with an adhesive seal 62 adhered to the walls 80*g* and 80*h* folded last and the wall 80*a*.

As shown in FIG. 18, the wall 80*g* is formed with a fitting portion 85 for fitting the cap 70. When the toner container 2 is to be used, the cap 70 is removed from the outlet portion 27 and then fitted in the fitting portion 85, as indicated by a solid line in FIG. 18. This prevents the cap 70 from obstructing the operation for mounting the toner container 2 to the apparatus body. Because the wall 80*g* with the fitting portion 85 is closed last together with the wall 80*h,* the cap 70 received in the fitting portion 85 is prevented from moving and is firmly connected to the box 80.

When the toner container 2 set on the apparatus body runs out of toner, it is picked up from the apparatus body. After the seal 60 has been removed, the walls 80*g* and 80*h* are unfolded or opened. In this condition, the empty bag 20 can be easily released from the box 80. The box 80 can be folded up in, e.g., two in a small size and is therefore easy to transport or store while occupying a minimum of space. This noticeably reduces the cost necessary for the box 80 to be distributed from the user's station to the manufacturer's station. Moreover, if the box 80 is formed of a material having certain durability, then it can be repeatedly used a plurality of times and therefore contributes a great deal to cost reduction.

As shown in FIG. 10 specifically, an indication 89 showing a disassembling procedure may be suitably provided on the wall of the box 80 that opens when the seal 60 is removed. For example, the indication 89 may be provided on the inside of the wall 80*h*. The indication 89 allows even the user to simply disassemble the box 80.

Air is sent into the bag 20 of the toner container 2, which is mounted to the image forming apparatus, in order to replenish the toner to the developing unit 1 while fluidizing it, as stated earlier. Therefore, even when the toner container 2 run out of toner is picked up from the apparatus, some air is left in the bag 20 and maintains the bag 20 slightly inflated. Further, when the toner container 2 is removed from the nozzle 30, the seal valve 23 tends to restore its original position, but fails to restore it and cannot preserve its original sealability. On the other hand, the empty bag 20 removed from the box 80 is burned or otherwise deal with for a reusing purpose by way of example. If the bag 20 is transported without being exhausted of air at the time of collection, the low-cost feature of the toner container 2 is canceled. However, because the seal valve 23 cannot preserve its original sealability, as stated above, pressure exerted on the bag 20 in the collapsing direction would cause the toner to fly about via the slightly open seal valve 23.

In light of the above, in the illustrative embodiment, the bag 20 is pressed in the collapsing direction after the cap 70 has been fitted on the outlet portion 27. As a result, air compressed within the bag 20 flows out of the bag 20 via the filters 28 that pass air, but do not pass the toner. This allows the bag 20 to be exhausted without causing the toner to fly about. Moreover, the cap 70 is connected to the bag 20 and therefore prevented from being lost.

Figure 21:
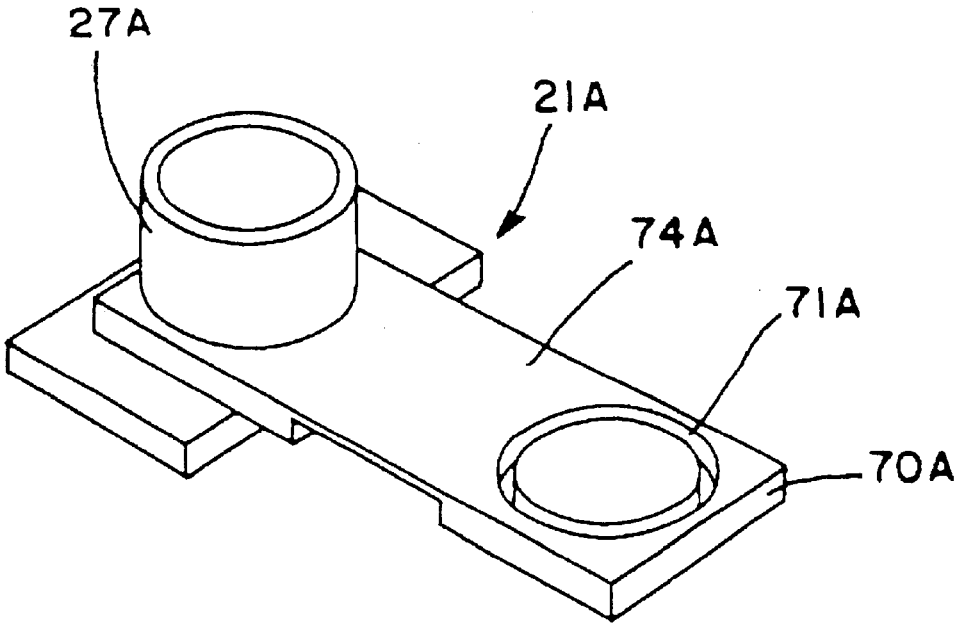
FIGS. 21 through 26 are isometric views each showing a specific modification of closing means included in the illustrative embodiment.
Figure 22:
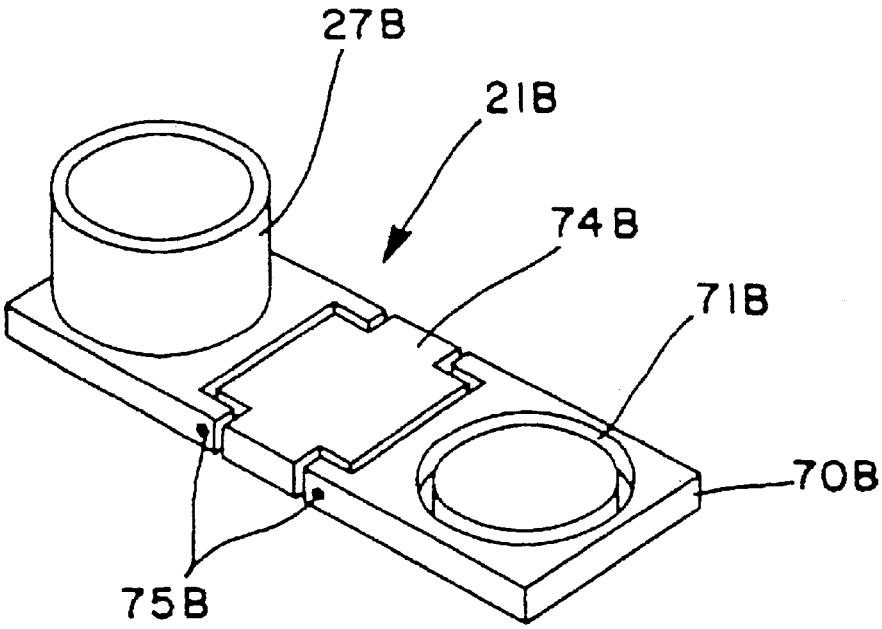
Figure 23:
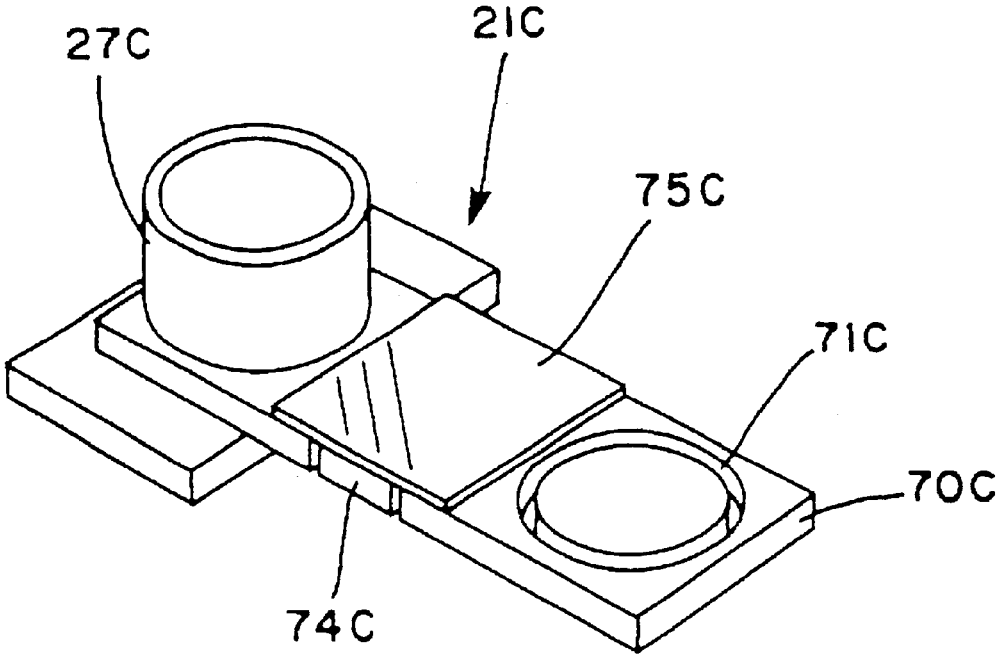
Figure 24:
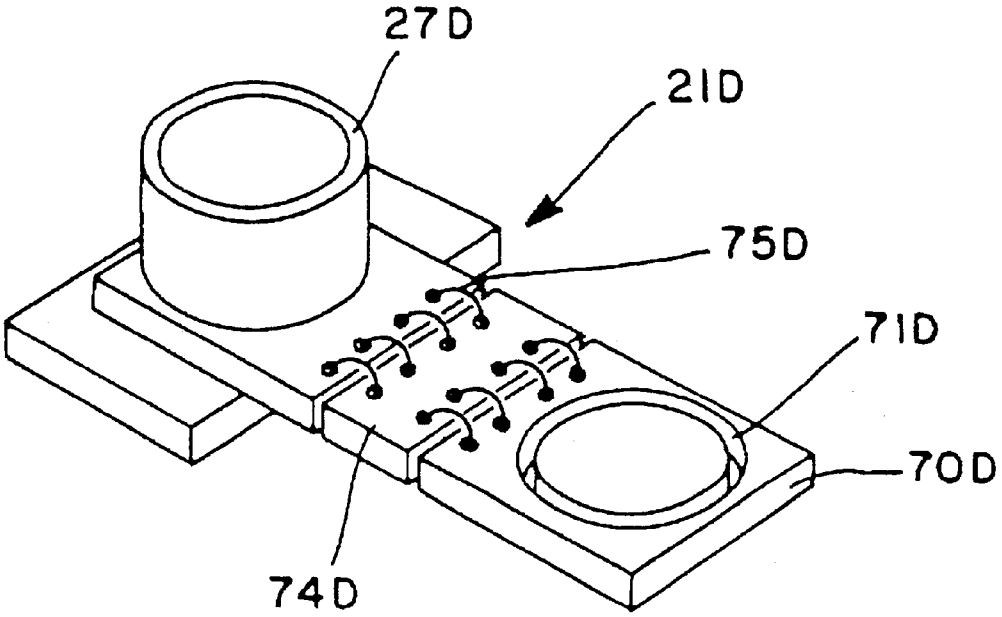
Figure 25:
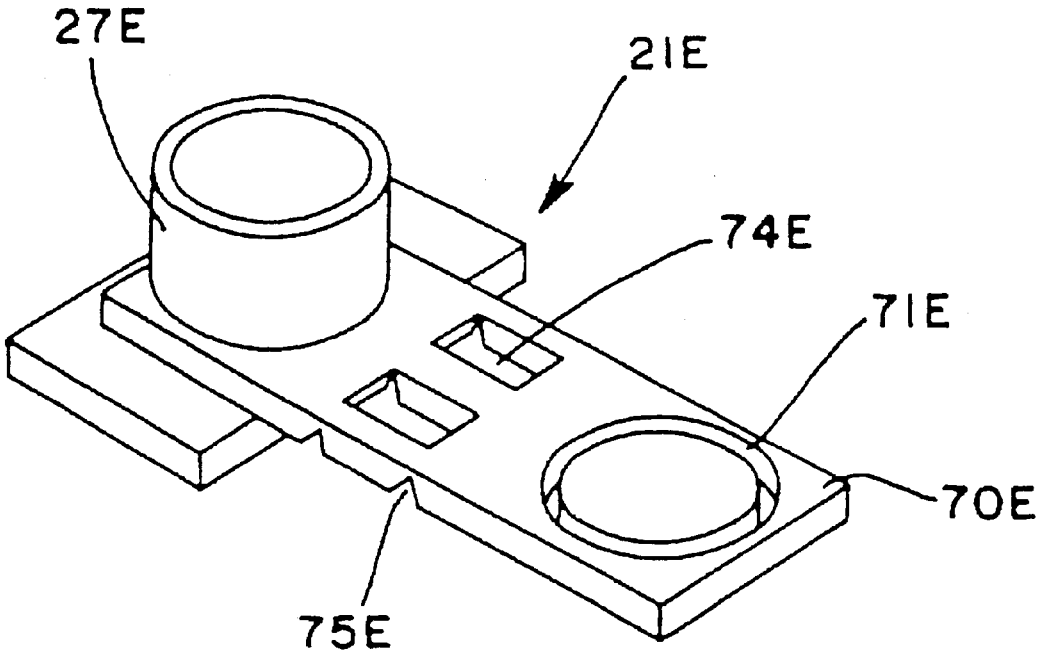
Figure 26:
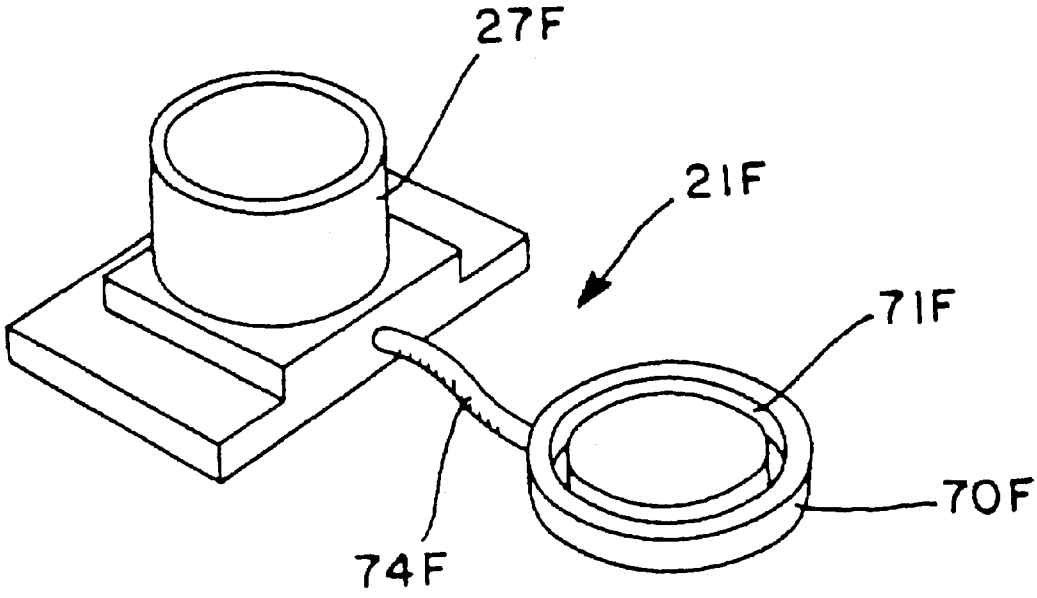

FIGS. 21 through 26 each shows a specific modification of the mouth member 21. In FIG. 21, a cap 70A is connected to a mouth member 21A by a flat, thin connecting portion 74A. In FIG. 22, a cap 70B is connected to a mouth member 21B by a connecting portion 74B; hinges 75B are a substitute for the V-shaped grooves and determine the previously stated folding position at the time of closing. In FIG. 23, an adhesive tape 75C extends from a mouth member 21C to a cap 70C via a connecting portion 74C. In FIG. 24, a mouth member 21D includes hinges 75D in place of the V-shaped grooves. The hinges 75D connect a cap 71D to the mouth member 21D via a connecting portion 74D and determine the folding position at the time of closing. In FIG. 25, a mouth member 21E has a connecting portion 74E and a cap 70E molded integrally with each other as in the illustrative embodiment. While the mouth member 21E determines the folding position by using a V-shaped groove 75E, it is formed with suitable openings in order to reduce the amount of material without lowering mechanical strength. Further, in FIG. 26, a cap 80F is connected to a mouth member 21F by a string-like connecting means 74F.

As stated above, the bag 20 of the toner container 2 is flexible while the box 50 or 80 can be folded up in a small size or developed in the form of a flat sheet. The toner container 2 is therefore easy to handle at the time of transport or storage while saving space, compared to a hard case. The bag 20 is collected by the manufacturer and then recycled, reused or burned. The box 50 or 80 with the above advantages noticeably reduces the cost necessary for the collection and distribution thereof. The mouth member 21, bag portion 22 and seal valve 23 of the bag 20 should preferably be formed of the same material or materials belonging to the same series, so that they do not have to be classified at the time of recycling.

In summary, the present invention achieves various unprecedented advantages, as enumerated below.

(1) Closing means closes an outlet portion in which a self-closing valve is fitted, surely preventing toner or similar powder from leaking.

(2) The closing means is connected to a powder storing body and is therefore prevented from being lost. In addition, a powder container can be assembled with the outlet portion being closed by the closing means.

(3) The closing means connected to the mouth member is folded by a preselected angle to a preselected position and is therefore easy to handle.

(4) The closing means brings about a minimum of additional cost.

(5) The closing means can be held at a position where it does not obstruct a mounting operation. In addition, the powder storing body and a box accommodating it can be firmly connected to each other.

(6) Air-permeable filters allow the powder storing body to be exhausted of air when the body is collapsed.

(7) The box can be developed in the form of a single sheet.

(8) Any person can easily frame the box.

(9) The box can be automatically framed by a machine.

(10) The box is framed before the powder storing body is put therein, and is therefore easy to frame.

(11) The powder storing body can be exhausted without causing the powder to fly about.

Various modifications will become possible for those skilled in the art after receiving the teachings of the present disclosure without departing from the scope thereof.

What is claimed is:

1. A powder container comprising:

a deformable, powder storing body storing powder therein;

a box more rigid than a bag for accommodating said powder storing body;

a powder outlet portion included in said powder storing body and partly showing itself at an outside of said box when said powder storing body is accommodated in said box;

a self-closing valve fitted in said powder outlet portion and opening when an insertion member is inserted or closing when said insertion member is pulled out; and closing means removably attached to said powder outlet portion for closing said self-closing valve.

2. The powder container as claimed in claim 1, further comprising a mouth member mounted on said powder storing body and formed with said powder outlet portion, wherein said self-closing valve is fitted in said mouth member.

3. The powder container as claimed in claim 2, wherein said insertion member comprises a nozzle in which a powder passage is formed.

4. The powder container as claimed in claim 3, wherein said closing means, said mouth member and a connecting portion connecting said closing means to said mouth member are formed of resin and molded integrally with each other.

5. The powder container as claimed in claim 4, further comprising a fitting portion included in said box for fitting said closing means when said closing means is removed from said powder outlet portion.

6. The powder container as claimed in claim 5, wherein said closing means removed from said powder outlet portion and said connecting portion are fitted in said fitting portion.

7. The powder container as claimed in claim 6, further comprising an opening/closing portion included in said box and openable when said powder storing body is to be inserted into said box, said fitting portion being formed on said opening/closing portion.

8. The powder container as claimed in claim 7, wherein said closing means comprises a cap removably fitted on said powder outlet portion.

9. The powder container as claimed in claim 1, wherein said insertion member comprises a nozzle in which a powder passage is formed.

10. The powder container as claimed in claim 9, wherein said closing means, said mouth member and a connecting portion connecting said closing means to said mouth member are formed of resin and molded integrally with each other.

11. The powder container as claimed in claim 10, further comprising a fitting portion included in said box for fitting said closing means when said closing means is removed from said powder outlet portion.

12. The powder container as claimed in claim 11, wherein said closing means removed from said powder outlet portion and said connecting portion are fitted in said fitting portion.

13. The powder container as claimed in claim 12, further comprising an opening/closing portion included in said box and openable when said powder storing body is to be inserted into said box, said fitting portion being formed on said opening/closing portion.

14. The powder container as claimed in claim 13, wherein said closing means comprises a cap removably fitted on said powder outlet portion.

15. The powder container as claimed in claim 1, wherein said closing means is connected to said powder storing body.

16. The powder container as claimed in claim 15, further comprising a mouth member mounted on said powder storing body and formed with said powder outlet portion, said closing means being connected at one end thereof to said mouth member via a connecting portion.

17. The powder container as claimed in claim 16, wherein said connecting portion is formed with grooves in the vicinity of opposite ends thereof for connection in order to determine folding positions.

18. The powder container as claimed in claim 17, wherein said closing means, said mouth member and a connecting portion connecting said closing means to said mouth member are formed of resin and molded integrally with each other.

19. The powder container as claimed in claim 18, further comprising a fitting portion included in said box for fitting said closing means when said closing means is removed from said powder outlet portion.

20. The powder container as claimed in claim 19, wherein said closing means removed from said powder toner outlet portion and said connecting portion are fitted in said fitting portion.

21. The powder container as claimed in claim 20, further comprising an opening/closing portion included in said box and openable when said powder storing body is to be inserted into said box, said fitting portion being formed on said opening/closing portion.

22. The powder container as claimed in claim 21, wherein said closing means comprises a cap removably fitted on said powder outlet portion.

23. The powder container as claimed in claim 1, further comprising a mouth member mounted on said powder storing body,and formed with said powder outlet portion, said closing means being connected at one end thereof to said mouth member via a connecting portion.

24. The powder container as claimed in claim 23, wherein said connecting portion is formed with grooves in the vicinity of opposite ends thereof for connection in order to determine folding positions.

25. The powder container as claimed in claim 24, wherein said closing means, said mouth member and a connecting portion connecting said closing means to said mouth member are formed of resin and molded integrally with each other.

26. The powder container as claimed in claim 25, further comprising a fitting portion included in said box for fitting said closing means when said closing means is removed from said powder outlet portion.

27. The powder container as claimed in claim 26, wherein said closing means removed from said powder outlet portion and said connecting portion are fitted in said fitting portion.

28. The powder container as claimed in claim 27, further comprising an opening/closing portion included in said box and openable when said powder storing body is to be inserted into said box, said fitting portion being formed on said opening/closing portion.

29. The powder container as claimed in claim 28, wherein said closing means comprises a cap removably fitted on said powder outlet portion.

30. The powder container as claimed in claim 1, wherein a connecting portion is formed with grooves in the vicinity of opposite ends thereof for connection in order to determine folding positions.

31. The powder container as claimed in claim 30, wherein said closing means, a mouth member and a connecting portion connecting said closing means to said mouth member are formed of resin and molded integrally with each other.

32. The powder container as claimed in claim 31, further comprising a fitting portion included in said box for fitting said closing means when said closing means is removed from said powder outlet portion.

33. The powder container as claimed in claim 32, wherein said closing means removed from said powder outlet portion and said connecting portion are fitted in said fitting portion.

34. The powder container as claimed in claim 33, further comprising an opening/closing portion included in said box and openable when said powder storing body is to be inserted into said box, said fitting portion being formed on said opening/closing portion.

35. The powder container as claimed in claim 34, wherein said closing means comprises a cap removably fitted on said powder outlet portion.

36. The powder container as claimed in claim 1, wherein said closing means, a mouth member and a connecting portion connecting said closing means to said mouth member are formed of resin and molded integrally with each other.

37. The powder container as claimed in claim 36, further comprising a fitting portion included in said box for fitting said closing means when said closing means is removed from said powder outlet portion.

38. The powder container as claimed in claim 37, wherein said closing means removed from said powder outlet portion and said connecting portion are fitted in said fitting portion.

39. The powder container as claimed in claim 38, further comprising an opening/closing portion included in said box and openable when said powder storing body is to be inserted into said box, said fitting portion being formed on said opening/closing portion.

40. The powder container as claimed in claim 39, wherein said closing means comprises a cap removably fitted on said powder outlet portion.

41. The powder container as claimed in claim 1, further comprising a fitting portion included in said box for fitting said closing means when said closing means is removed from said powder outlet portion.

42. The powder container as claimed in claim 41, wherein said closing means removed from said powder outlet portion and said connecting portion are fitted in said fitting portion.

43. The powder container as claimed in claim 42, further comprising an opening/closing portion included in said box and openable when said powder storing body is to be inserted into said box, said fitting portion being formed on said opening/closing portion.

44. The powder container as claimed in claim 43, wherein said closing means comprises a cap removably fitted on said powder outlet portion.

45. The powder container as claimed in claim 1, wherein said closing means comprises a cap removably fitted on said powder outlet portion.

* * * * *